US006317308B1

(12) United States Patent
Durif et al.

(10) Patent No.: US 6,317,308 B1
(45) Date of Patent: Nov. 13, 2001

(54) CONTROL DEVICE OF AN ELECTROMAGNET, WITH DETECTION OF AN UNSCHEDULED MOVEMENT OF THE MOVABLE CORE OF THE ELECTROMAGNET

(75) Inventors: Ghislain Durif, Meylan; Mustapha Chelloug, Echirolles, both of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/447,733

(22) Filed: Nov. 23, 1999

(30) Foreign Application Priority Data

Dec. 7, 1998 (FR) ..... 98 15554

(51) Int. Cl.[7] ..... H01H 47/00
(52) U.S. Cl. ..... 361/143; 361/152; 361/160
(58) Field of Search ..... 361/152, 160, 361/143, 231

(56) References Cited

U.S. PATENT DOCUMENTS 5,539,608 * 7/1996 Hurley et al. ..... 361/152

FOREIGN PATENT DOCUMENTS 0 779 631 A2 6/1997 (EP) ..... H01F/7/18
0 411 903 A2 2/1991 (EP) ..... H01H/47/00

* cited by examiner

*Primary Examiner*—Stephen W. Jackson
(74) *Attorney, Agent, or Firm*—Parkhurst & Wendel, L.L.P

(57) ABSTRACT

The device comprises means for detecting an unscheduled movement of the movable core of an electromagnet during a holding phase. For this, a control and regulation circuit monitors the current flowing in at least one coil of the electromagnet. When, during a holding phase, the current flowing in the coil is greater than a setpoint value and either remains so during a preset time or is increasing, an unscheduled movement is then considered as being detected and the device makes the electro-magnet switch to inrush phase with a much higher current.

10 Claims, 5 Drawing Sheets

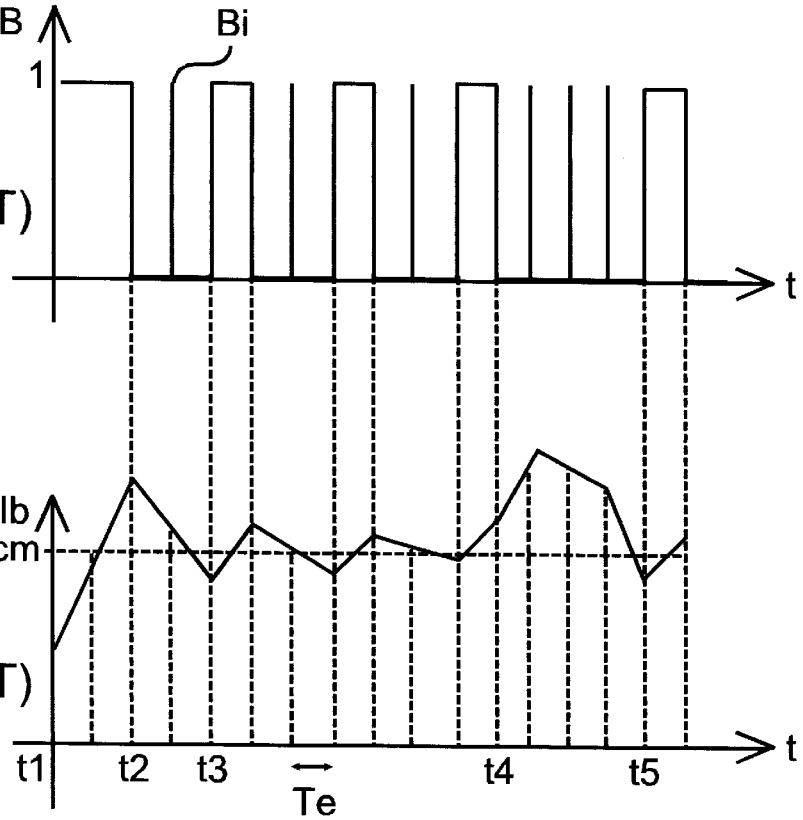
FIG. 3a
(PRIOR ART)
FIG. 3b
(PRIOR ART)
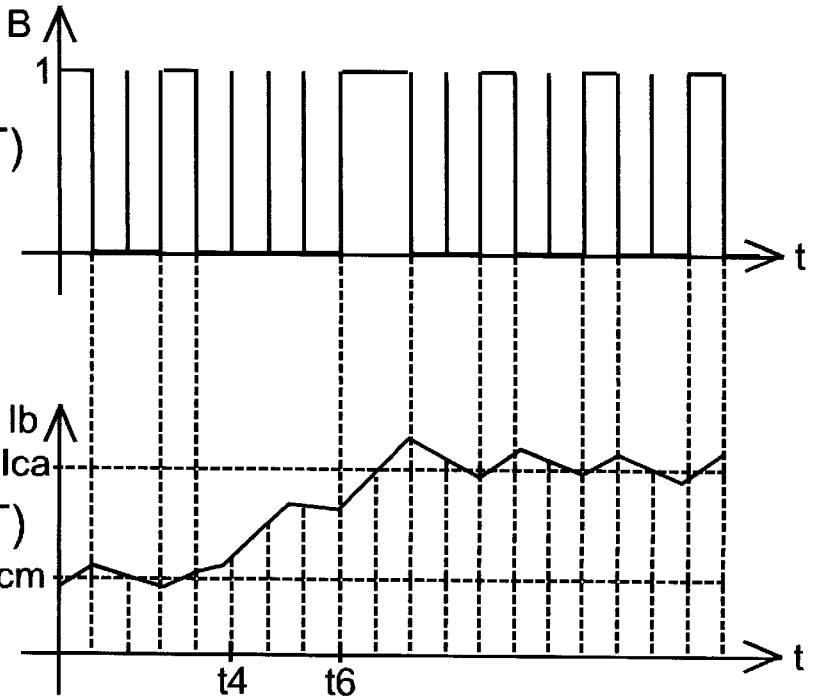
FIG. 4a
(PRIOR ART)
FIG. 4b
(PRIOR ART)

FIG. 5a
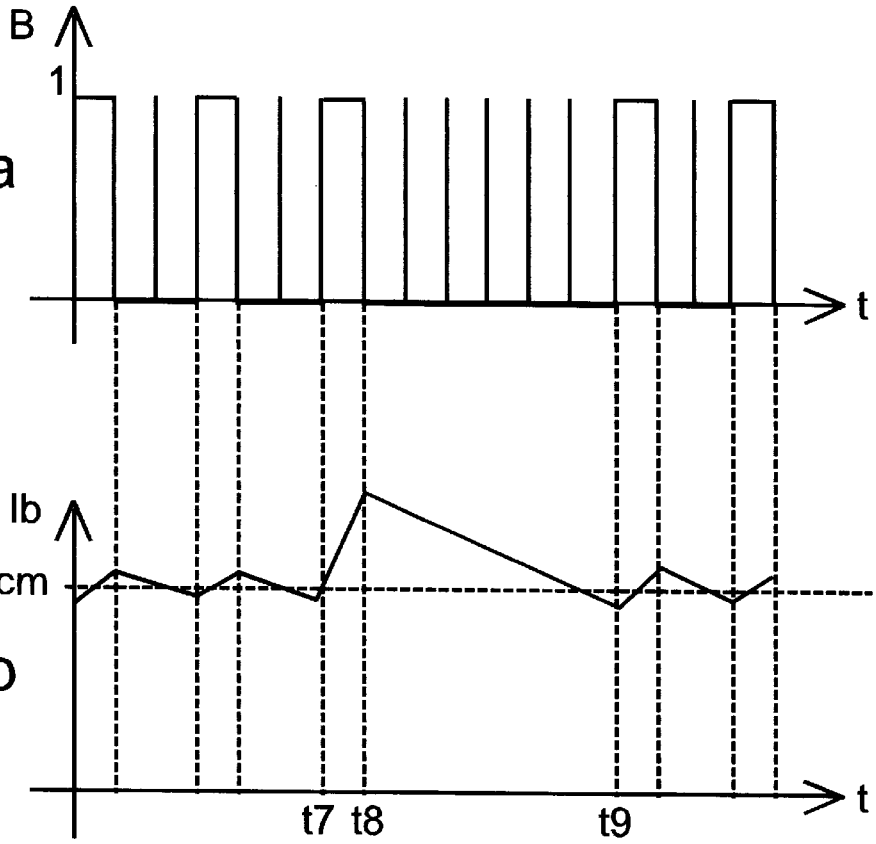
FIG. 5b
FIG. 6
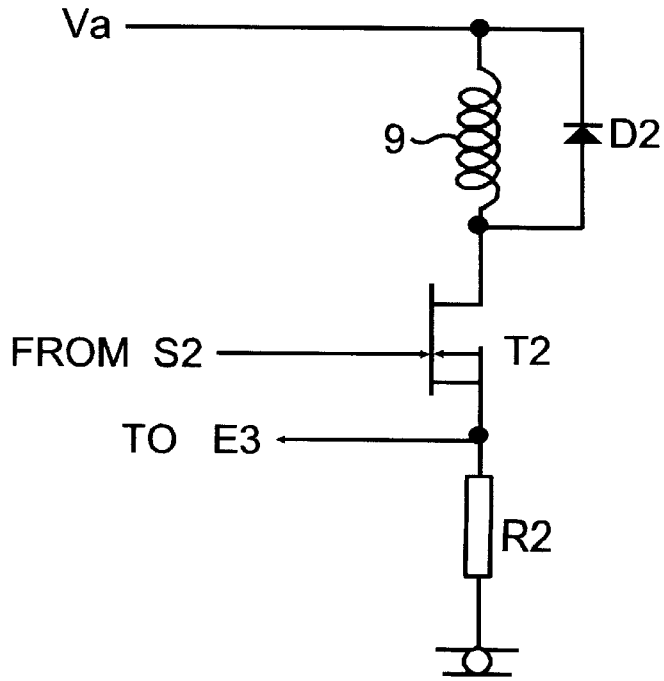

CONTROL DEVICE OF AN ELECTROMAGNET, WITH DETECTION OF AN UNSCHEDULED MOVEMENT OF THE MOVABLE CORE OF THE ELECTROMAGNET

BACKGROUND OF THE INVENTION

The invention relates to a control device of an electromagnet comprising a movable core, with at least one inrush phase during which the electromagnet receives an inrush current, and a holding phase during which it receives a holding current weaker than the inrush current, the device comprising at least one coil connected in series with an electronic switch to the terminals of a supply voltage, means for measuring the current flowing in the coil and means for control of the electromagnet, connected to the means for measuring the current and to a control electrode of the electronic switch and comprising means for regulating the current in the coil during the holding phase.

For control of an electromagnet, it is known (FR-A-2,133,652) to supply it temporarily with a relatively high inrush current, followed by a lower holding current. This can be achieved either with a device comprising a single coil, in which the current is switched to constitute the holding current, or with a double coil formed by an inrush coil and a holding coil. It is also known to regulate the inrush and holding currents to preset levels (FR-A-2,568,715).

An electromagnet conventionally comprises a movable core, movement of which to a position in which the electromagnet is actuated is caused by the flow of the inrush current in the inrush coil. It is then held in this position by the flow of the holding current in the holding coil, which may be the same as the inrush coil. To reduce the temperature rise of electromagnets the holding current is sought to be decreased. In certain cases, this decrease of the holding current gives rise to problems due to the existence of shocks, in particular mechanical shocks, liable to cause an unscheduled movement of the movable core to the rest position of the electromagnet.

This type of problem occurs in particular in contactors or in electrical auxiliaries of circuit breakers, for example with circuit breaker opening electromagnets (under-voltage MN or shunt MX) or closing electromagnets (XF).

In a more general manner, seeking to reduce the volumes of the electromagnets leads to a decrease of the power able to be dissipated by the coils and makes the electromagnets more sensitive to shocks.

SUMMARY OF THE INVENTION

The object of the invention is to overcome these drawbacks.

According to the invention, this object is achieved by the fact that the control means comprise detection means for detecting an unscheduled movement of the movable core of the electromagnet during a holding phase according to the value of the current flowing in the coil when said current is greater than the setpoint value during the holding phase, and means for commanding switching to inrush phase when an unscheduled movement is detected.

Fast detection of a shock enables switching to inrush phase to be performed and the movable core to be relatched before its movement has had an impact on the device it controls.

According to a first development of the invention, the detection means comprise means for detecting the direction of variation of the current flowing in the coil, an unscheduled movement being considered as being detected when, during the holding phase, the current is greater than the setpoint value and is at the same time increasing.

The means for detecting the direction of variation of the current then preferably comprise means for determining a quantity representative of the differential of the current with respect to time, an unscheduled movement being considered as being detected when, during the holding phase, the current is greater than the setpoint value and said quantity is positive.

According to a second development of the invention, an unscheduled movement is detected by the detection means when, during the holding phase, the current is greater than the setpoint value during a preset time.

BRIEF DESCRIPTION OF THE DRAWINGS

Other advantages and features will become more clearly apparent from the following description of particular embodiments given as non-restrictive examples only and represented in the accompanying drawings in which:

FIGS. 3*a* and 3*b* respectively represent the variations versus time, during a holding phase, of the signals B and Ib of a device according to FIG. 1 in which regulation is performed from current samples.

FIGS. 4*a* and 4*b* respectively represent the signals B and Ib of an embodiment of a device according to the invention before and after detection of a shock.

FIGS. 5*a* and 5*b* respectively represent the signals B and Ib of a device according to FIG. 1, in the case where regulation is poor.

FIG. 6 schematically illustrates additional elements of the device according to FIG. 1 in an embodiment comprising an inrush coil.

DETAILED DESCRIPTION OF THE PREFERRED EMBODIMENT

Figure 1:
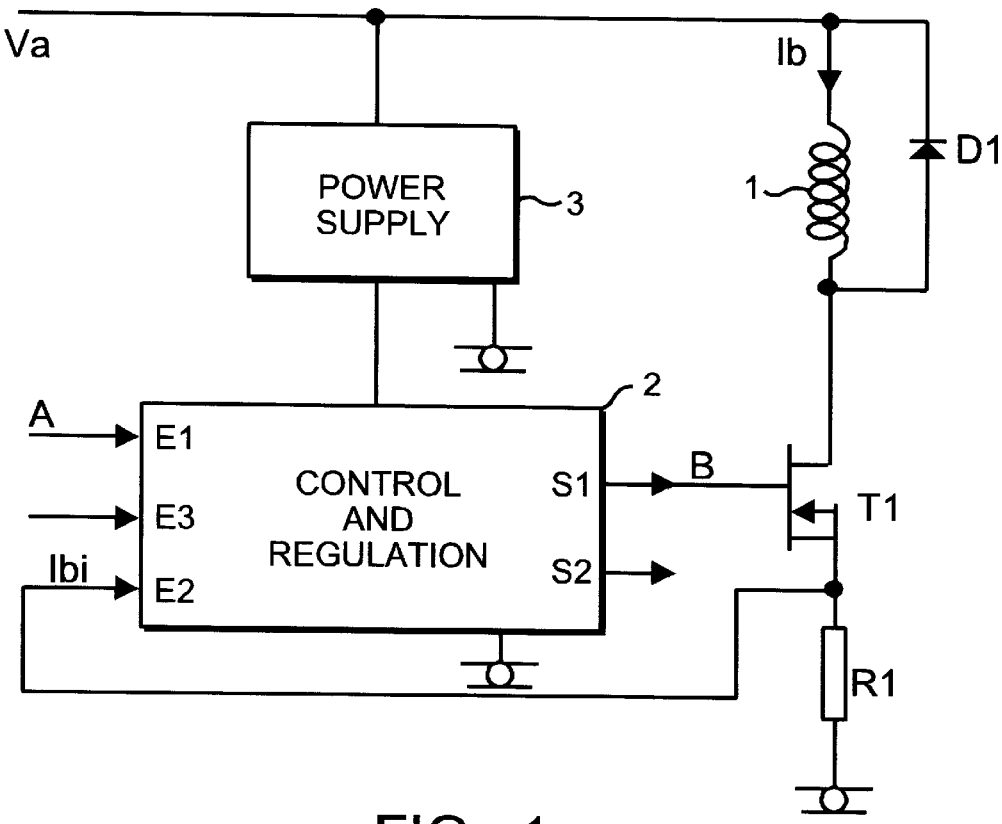
FIG. 1 (PRIOR ART)
FIG. 1 represents a control device of an electromagnet according to the prior art.

The device according to FIG. 1, which is of the type described in the document FR-A-2,568,715, comprises a coil 1 connected in series with a transistor T1 and a measuring resistor R1 to the terminals of a supply voltage Va. In conventional manner, a free-wheel diode D1 is connected in parallel with the coil 1. An output S1 of a control and regulation circuit 2 is connected to a control electrode of the transistor T1 to which it supplies control signals B. An input E1 of the circuit 2 receives control signals A of the electromagnet. The circuit 2 is also connected to the terminals of the resistor R1 so as to receive, on an input E2, signals Ib representative of the current Ib flowing in the coil 1 when the transistor T1 is turned on. The circuit 2 thus both enables the device to be controlled and the current in the coil to be regulated to preset values, independent of the supply voltage Va. A power supply circuit 3, connected to the terminals of the voltage Va supplies a stabilized auxiliary supply voltage to the circuit 2.

Figure 2:
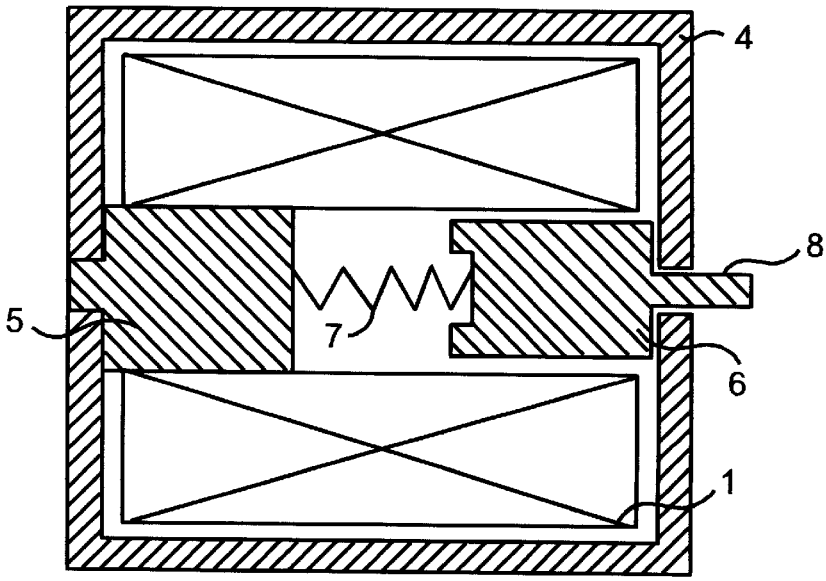
FIG. 2 (PRIOR ART)
FIG. 2 represents an electromagnet of known type, in schematic manner in cross-section.

The electromagnet, of known type, represented in FIG. 2, comprises an armature 4 inside which the coil 1 is housed. The coil 1 surrounds a fixed core 5 secured to the armature, and a movable core 6. A spring 7 is fitted between the fixed core and the movable core so as to separate the movable core 6 from the fixed core 5. In the rest position of the electromagnet, represented in FIG. 2, a plunger 8 securedly affixed to the movable core protrudes out from the armature 4.

When a control order A is applied to the input E1 of the circuit 2, the latter first passes via an inrush phase. During the inrush phase, the signals B order turn-on of the transistor T1, i.e. closing of the electronic switch formed by the transistor, so that a relatively high current Ib, or inrush current, flows in the coil 1. The flow of the inrush current in the coil 1 causes movement of the movable core 6 in the direction of the fixed core 5, against the action of the spring 7. When the cores are in contact, the plunger 8 no longer protrudes out from the armature 4. Conventionally, the position of the plunger 8 enables opening or closing of a device, for example a contactor or a circuit breaker, to be controlled.

The inrush phase lasts for a sufficiently long time to allow a complete movement of the movable core 6 to take place and for the latter to come into contact with the fixed core 5. Subsequently, the flow of a high inrush current is no longer necessary to hold the movable core in the actuating position of the electromagnet and, conventionally, the control and regulation circuit 2 switches to a holding phase. During the holding phase, the signals B command turn-on of the transistor T1 so that a holding current Ib, weaker than the inrush current, flows in the coil 1.

In a preferred embodiment, the holding current Ib is regulated by the circuit 2 so as to be close to a setpoint value Icm of the holding current. In known manner, the circuit 2 can be formed by an analog circuit or by a digital circuit, for example with a micro-processor. In the prior art regulation is performed by pulse width modulation (PWM) of a high fixed frequency control signal B.

FIGS. 3*a* and 3*b* illustrate the signals B and the current Ib during a holding phase and the consequences of a shock in a device according to FIG. 1 in which regulation is performed from samples $Ib_i$ of the current taken at a preset fixed sampling frequency.

At a time t1, the current Ib being lower than the setpoint value Icm, the signal B is at a logic value 1 and the transistor T1 is turned on. In FIG. 3*b,* the current Ib is sampled with a sampling period Te by the circuit 2. So long as the holding current Ib is lower than the setpoint value Icm, the signal B remains at 1 and the current in the coil increases. When, at a time t2, a sample $Ib_i$ of the current Ib reaches or exceeds the setpoint value Icm, the signal B switches to 0, thus ordering switching to an opening phase of the electronic switch formed by the transistor T1. The latter being turned-off, the current in the coil starts to decrease. During the opening phase, the circuit 2 periodically sends sampling pulses Bi to the base of the transistor T1, so as to turn the latter on and to enable measurement at the terminals of the resistor R1 of a sample $Ib_i$ of the current Ib flowing in the coil. These periodic pulses Bi, with a period Te, have a very short duration so as not to influence the value of the current Ib in the coil. These pulses are represented in FIGS. 3*a,* 4*a* and 5*a*. In the whole of the following part of the description the transistor T1 is considered as being in an opening phase of the holding phase so long as the signal B remains at 0 outside the sampling times. In normal operation, the current Ib drops back below the setpoint value Icm after one or two sampling periods, for example at the time t3 in FIG. 3*b*. This is then detected by the circuit 2 which terminates the opening phase by resetting the signal B to the logic value 1, commanding a new turn-on of the transistor T1 and increase of the current Ib during at least one sampling period.

A mechanical shock exerted on the electromagnet or on the device it controls may cause movement of the movable core 6 away from the fixed core 5 when the holding current is too weak.

The consequences of a shock of this type are represented in FIGS. 3*a* and 3*b* at a time t4. The shock causes a beginning of movement of the movable core. This movement causes production in the coil of an electromotive force which results in generation of an additional current which is added to the regulated holding current. Consequently, after the time t4, an increase of the current Ib occurs in spite of regulation, i.e. in the particular embodiment represented, although the transistor T1 is in an opening phase (B=0 outside the sampling pulses). If no particular measure is taken, the current Ib can take the form represented in FIG. 3*b,* between the times t4 and t5: increase, then passing via a maximum and decrease until it drops below the setpoint value Icm.

At the time t5, the microprocessor restarts controlling regulation of the holding current in the coil. However, this holding current is insufficient to relatch the movable core 6 against the fixed core 5. The shock thus leads to unscheduled de-excitation of the electromagnet. For example in the case where the electromagnet forms part of a circuit breaker under-voltage release (MN), the electromagnet can be of the type represented in FIG. 2. In the excited position of the electromagnet, with the cores 5 and 6 in contact, the plunger 8 is in the withdrawn position. When the voltage applied to its control device falls below a preset value, the current flow is interrupted in the coil and the movable core 6 moves away from the fixed core 5 due to the action of the spring 7. The plunger 8 then protrudes outwards causing immediate opening of the circuit breaker. Subsequent closing of the circuit breaker is only possible when, the under-voltage release being supplied, the movable core 6 is brought back into contact with the fixed core 5. An unscheduled shock as described above may lead to opening of the circuit breaker. The holding current supplied to the electromagnet after the time t5 being insufficient to bring back the cores into contact, it is then impossible to reclose the circuit breaker before cutting the power supply of the trip release and then resupplying it, which causes an inrush phase and brings the cores into contact.

According to the invention, an unscheduled movement of the movable core in the course of a holding phase is quickly detected and switching to an inrush phase is commanded as soon as such a movement is detected. Due to the fast switching to inrush phase, the effects of the unscheduled shock are either completely eliminated or reduced. As an example, in the case of an under-voltage release (MN), if the unscheduled shock is detected early enough when movement of the movable core 6 occurs and the inrush phase takes place before the plunger 8 has been able to bring about opening of the circuit breaker, the shock does not have any consequences. If the shock is detected later, the circuit breaker can open due to the action of the plunger 8. However, automatic switching to inrush phase when the shock is detected automatically brings back the core into contact and enables reclosing of the circuit breaker. In this case, although the drawbacks connected with the unscheduled shock are not totally eliminated, they are however reduced.

FIGS. 4*a* and 4*b* illustrate the signals B and Ib in a device according to the invention. Up to the time t4, the device performs, as previously, regulation of the holding current around the setpoint value Icm. At the time t4, when an unscheduled shock occurs, the current Ib increases. In a first alternative embodiment, if, during an opening phase of the holding phase, the control device detects four successive samples $Ib_i$ greater than the setpoint value Icm, it considers that this is due to a shock and causes switching to inrush phase. This alternative embodiment is illustrated in FIGS. 4*a* and 4*b*. At the time t6, four successive samples greater than Icm have been detected since the time t4. The control and regulation circuit 2 then causes turn-on of the transistor T1 (B=1) until the current Ib in the coil 1 reaches an inrush setpoint value Ica. It then regulates the current in the coil so that this current is equal to the value Ica during the inrush phase. The value Ica is much higher than the value Icm (10 to 20 times) and causes brings the movable and fixed cores into contact. Conventionally, after a preset time (80 ms for example), the control circuit again switches to holding phase.

In some cases, this shock detection criterion does however prove insufficient. Such a case is illustrated in FIGS. 5*a* and 5*b*. In these figures, the electromagnet is in holding phase, with regulation of the current Ib in the coil to the setpoint value Icm. It may happen, as represented between the times t7 and t8, that when closing of the transistor T1 takes place (B=1), the current Ib in the coil increases quickly. This can be the case in particular if the supply voltage Va, which is generally a full-wave rectified AC voltage, punctually has a too high peak voltage. After detecting, at the time t8, a first sample greater than the setpoint value Icm, the control circuit causes, normally, turn-off of the transistor T1 (B=0) and switching to opening phase. The current Ib then drops back down to the setpoint value Icm. However, the maximum value reached by the current Ib at the time t8 being relatively high, it needs a period greater than two sampling periods Te to drop back below Icm. In FIG. 5*b*, the current Icm drops back below the setpoint value Icm at a time t9 only, after five successive samples of the current Ib have been greater than the setpoint value. In the alternative embodiment described above, with reference to FIGS. 4*a* and 4*b*, this is interpreted by the control circuit 2 as being due to a shock having caused an unscheduled movement of the movable core. However this is not the case and it is in fact due to poor regulation. In the first alternative embodiment, the control circuit would then switch to inrush phase, whereas this is pointless. Too frequent use of the inrush phase would lead to a high dissipation of energy in the coil, which could result in destruction of the device.

According to a development of the invention, such unscheduled switchings to inrush phase are sought to be eliminated. For this, it is possible to increase the duration of the minimum observation window during which the current Ib must be greater than the setpoint value to conclude that unscheduled movement of the movable core has taken place. At fixed sampling frequency, this means increasing the number of successive samples greater than Icm necessary to conclude that a shock has occurred. But this leads to decreasing the speed of reaction of the device and to allowing a greater movement of the movable core before reacting.

Comparison of FIGS. 4*b* and 5*b* shows that, although in these two cases, during the periods t4–t6 and respectively t8–t9, the current Ib remains greater than the threshold Icm, the variations of Ib are on the other hand totally different. In the case of a shock (FIGS. 3*b* and 4*b*, from the time t4), movement of the movable core causes an electro-motive force to occur in the coil and consequently causes an increase of the current despite turn-off of the transistor T1 outside the sampling times. On the other hand, in the case of poor regulation (FIG. 5*b*, from the time t8), the current Ib decreases as soon as the transistor T1 is in an opening phase.

In a preferred embodiment, a shock is detected when, the transistor T1 being in an opening phase, the current Ib is greater than the setpoint value Icm and at the same time the current Ib in the coil is increasing. To detect such an increase, the control circuit 2 can determine a quantity representative of the differential of the holding current with respect to time, dIb/dt. When this quantity is positive, this means that the current Ib is increasing and this increase, when B=0 outside the sampling times and Ib>Icm, is interpreted as corresponding to an unscheduled movement of the core which must lead to switching to inrush phase.

In FIGS. 1 and 2, the control device comprises a single coil, and in FIGS. 4*a* and 4*b* the control circuit 2 regulates the current in the coil either to the value Icm during a holding phase or to the value Ica during an inrush phase.

The invention applies in the same way if the current is not regulated during the inrush phase. The transistor T1 then remains on (B=1) throughout the inrush phase. It also applies if the device comprises a double coil, the coil 1 then constituting the holding coil and another coil constituting the inrush coil which only has a current, regulated or not, flowing through it during the inrush phase.

FIG. 6 illustrates the complementary elements of an embodiment with double coil. An inrush coil 9 is connected in series with a transistor T2 and a measuring resistor R2 to the terminals of the supply voltage Va. A free-wheel diode D2 is connected in parallel with the inrush coil 9. The control electrode of the transistor T2 is connected to an output S2 of the control and regulation circuit 2. If the current in the inrush coil 9 has to be regulated during the inrush phase, the point common to R2 and T2 is connected to an input E3 of the circuit 2.

The control and regulation circuit 2 can be achieved by any suitable, analog or digital, means. In a preferred embodiment, it comprises a microprocessor which performs sampling, with a sampling period Te, of the signals applied to its inputs E2 and E3, analog-to-digital conversion of these signals, comparison of these signals with the setpoint values Icm and Ica, respectively during the holding and inrush phases, and control of the transistors T1 and T2.

Figure 7:
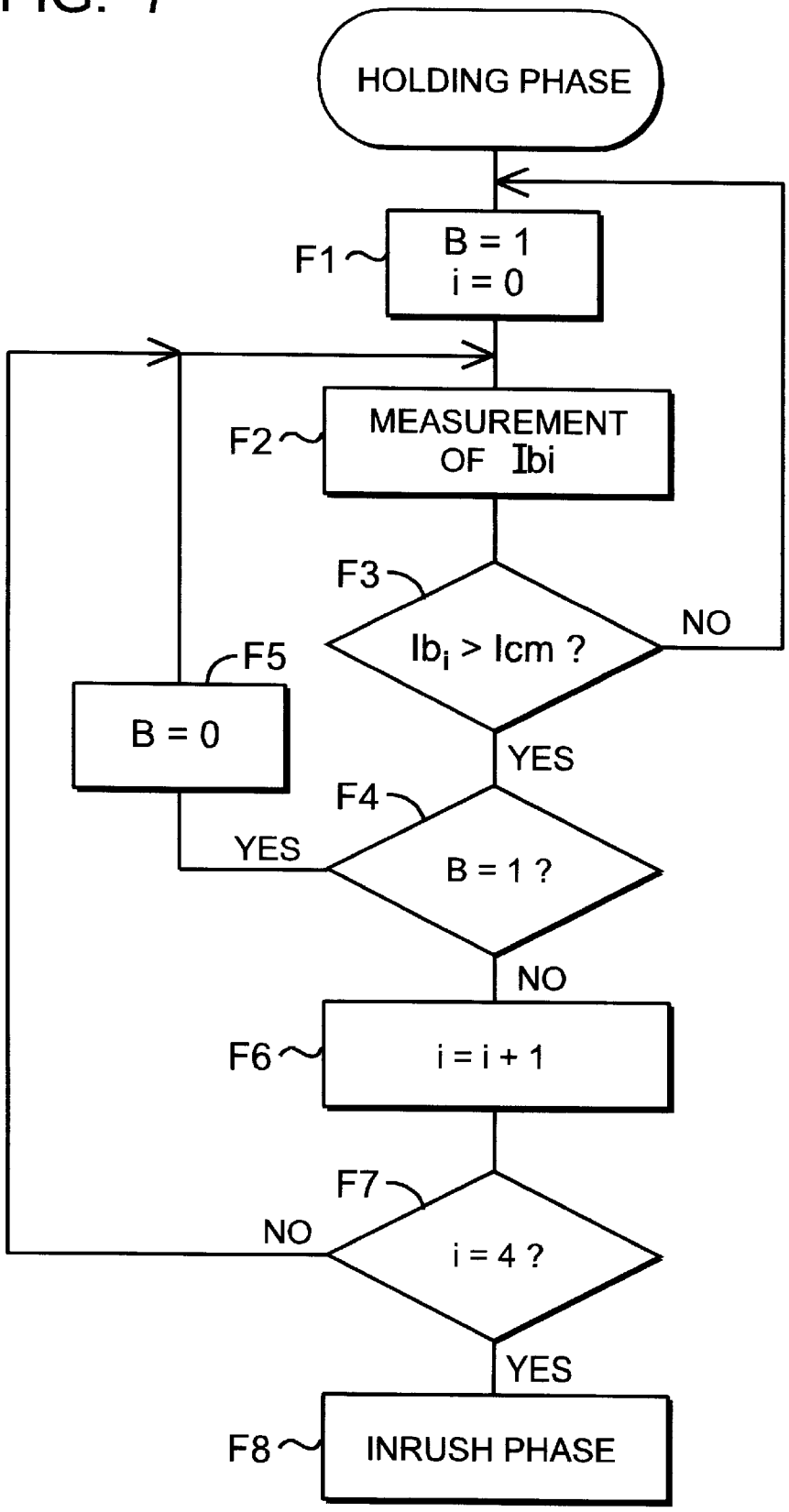
FIG. 7 represents a particular embodiment of a sub-routine corresponding to a holding phase in a device according to the invention.

FIG. 7 illustrates a particular sub-routine corresponding to a holding phase and implementing the alternative embodiment of the invention described with reference to FIGS. 4*a* and 4*b*, i.e. detecting a shock when Ib is greater than Icm during at least 4 successive samples of an opening phase of the transistor T1 (B=0 outside the sampling times).

During a first step F1 of initialization of the holding phase, the signal B is set to 1 (turn-on of T1) and an indicator i is set to zero. Then the microprocessor of the circuit 2 goes on to a step F2 of measuring a sample $Ib_i$ of the current flowing in the coil 1. If B is zero, a sampling pulse Bi is transiently applied to the base of the transistor T1, the value of B not changing in the routine. In a step F3, the microprocessor compares, the sample $Ib_i$ with the setpoint value Icm. If $Ib_i$ is not greater than the setpoint value (NO output of F3), the microprocessor loops back to the input of the step F1. The transistor T1 therefore remains turned-on and the current Ib continues to rise. This takes place, for example, between the times t1 and t2 of FIG. 3*b*. If on the other hand, at F3, $Ib_i$ is greater than Icm (YES output of F3), then the micro-processor checks, in a step F4, if B=1. If B=1 (times t2 and t3 of FIG. 3*b*), the microprocessor then goes on to a step F5 where B is set to zero, commanding switching to an opening phase of the transistor T1, before returning to the input of the step F2. The sub-routine described up to now corresponds to regulation of the current Ib to the value Icm during the holding phase. If, at F4, B=0 (NO output of F4), the indicator i is then incremented (i=i+1) in a step F6. Then, in a step F7, the microprocessor checks if i=4. If this is not the case (NO output of F7), it returns to the input of F2. If on the other hand i=4, this means that four successive samples $Ib_i$ have been greater than Icm during the opening phase of the transistor T1. This is considered as being representative of an unscheduled shock having led to a beginning of unscheduled movement of the movable core 6 of the electromagnet. The microprocessor then goes on (YES output of F7) to a stage F8 corresponding to an inrush phase.

The number of samples used in the phase F7 can be modified in particular according to the sampling frequency and the speed of reaction required. The number of samples greater than Icm whereas B=0 must at the minimum be greater than or equal to 2. This corresponds to more than two successive samples greater than Icm during the holding phase, the first sample leading to turn-off of T1. The value 4 is a preferred value which gives satisfactory results when the supply voltage Va is a full-wave rectified voltage from a 50 or 60 Hz electrical power system and for a sampling period of about a few hundred microseconds.

Figure 8:
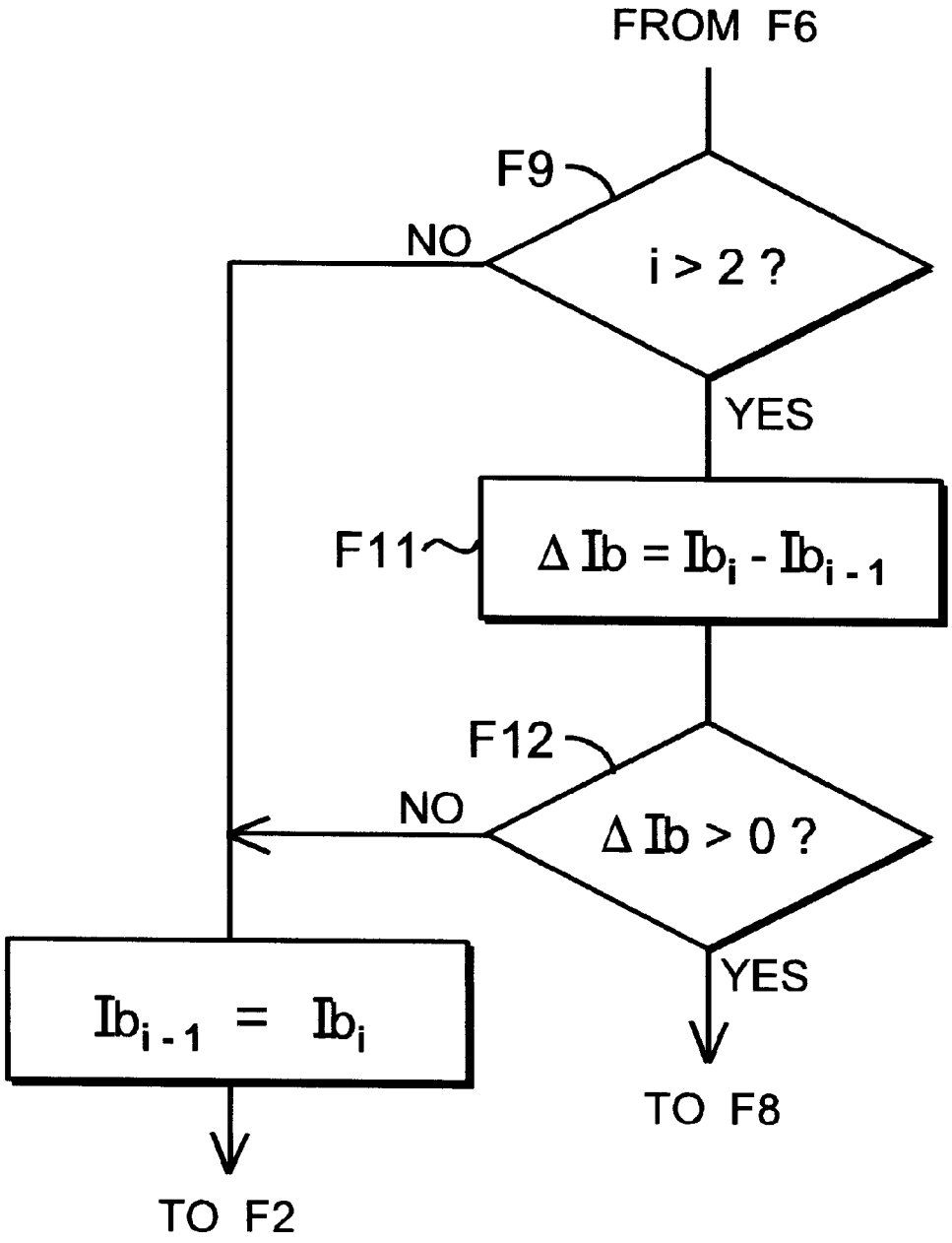
FIG. 8 represents an alternative version of the sub-routine of FIG. 7.

FIG. 8 represents an alternative version of the sub-routine of FIG. 7 in the case where the decision criterion used is no longer the number of successive samples greater than Icm but the direction of variation of the holding current when Ib>Icm during an opening phase of the transistor T1.

The sub-routine corresponding to the holding phase remains identical up to the step F6. In the alternative version of FIG. 8, at the output of the step F6, the micro-processor checks, in a step F9, if the indicator i is equal to or greater than 2. If this is not the case (NO output of F9), i.e. if i=1, that is to say that a single sample $Ib_i$ greater than Icm has been measured during an opening phase of the transistor T1, this sample is stored in a step F10 at a location $Ib_{i-1}$ ($Ib_{i-1}=Ib_i$). Then the microprocessor goes back to the input of the step F2 for measurement of the following sample $Ib_i$. If on the other hand, at F9, i is greater than or equal to 2, then (YES output of F2) the microprocessor goes on to a step F11 of determining a quantity $\Delta Ib=Ib_i-Ib_{i-1}$. The quantity ΔIb is representative of the direction of variation of the current Ib after turn-off of the transistor T1 at the beginning of the opening phase and more particularly representative of the differential of the holding current with respect to time between two successive samples during this phase. Then, in a step F12, the microprocessor checks the sign of ΔIb. If the quantity ΔIb is negative or zero (NO output of F12), it goes on to the step F10, storing the last sample before measuring the next one. If on the other hand at F12 the quantity ΔIb is positive (YES output of F12), then, the current being increasing, the microprocessor considers that an unscheduled shock has taken place leading to movement of the movable core and goes to the inrush phase (F8).

In the above description regulation is performed from periodic sampling of the current Ib in the coil.

The invention is also applicable when regulation is performed by pulse width modulation (PWM) as in the prior art mentioned above. In this case the transistor T1 operates as a chopper with a fixed chopping frequency and a variable duty cycle factor. During a period Th corresponding to the chopping frequency, the transistor T1 is turned on (B=1) during a variable period Th1 (Th1<Th). The duration of the period Th1 is a function of the difference between the measured current Ib and the setpoint value (Icm during the holding phase). When the current is equal to the setpoint value, the turn-on period Th1 takes a preset value Th1c corresponding to a setpoint duty cycle factor Nc=Th1c/Th, which is for example 0.5. When the current Ib in the coil is lower than the setpoint value Icm, the turn-on period Th1 increases and the duty cycle factor N=Th1/Th is consequently greater than Nc. When the current Ib in the coil is greater than the setpoint value, the turn-on period Th1 is lower than Th1c, and the duty cycle factor N is consequently lower than Nc.

To detect an unscheduled movement of the movable core, it is possible, in a similar manner to the embodiment described in FIG. 7, to determine whether the current Ib remains greater than the setpoint value Icm during a preset period. To do this the circuit 2 compares the value of the duty cycle factor N with the setpoint duty cycle factor Nc during each chopping cycle or period Th. If N remains greater than Nc during a preset number of successive cycles (at least 2, preferably 4), the circuit 2 then considers that unscheduled movement of the movable core has taken place and commands switching to inrush phase.

In a preferred embodiment, the circuit 2, in similar manner to the embodiment described in FIG. 8, takes account of the direction of variation of the holding current when Ib>Icm. To do this it compares the successive duty cycle factors when N is lower than Nc (Ib>Icm) and considers that unscheduled movement of the movable core has taken place when the duty cycle factor N being lower than Nc during at least two successive cycles, this duty cycle factor is decreasing. This in fact means that the current is both increasing and greater than the setpoint value Icm during more than one chopping period. As previously, it then commands switching to inrush phase.

In all cases, detection of an unscheduled movement of the movable core during a holding phase is linked to monitoring of the current in the coil during a holding phase and detection of such a movement causes switching to inrush phase.

What is claimed is:

1. A control device of an electromagnet comprising a movable core, with at least one inrush phase during which the electromagnet receives an inrush current, and a holding phase during which it receives a holding current weaker than the inrush current, the device comprising at least one coil connected in series with an electronic switch to the terminals of a supply voltage, means for measuring the current flowing in the coil and means for control of the electromagnet, connected to the means for measuring the current and to a control electrode of the electronic switch and comprising means for regulating the current in the coil during the holding phase, wherein the control means comprise detection means for detecting an unscheduled movement of the movable core of the electromagnet during a holding phase according to the value of the current flowing in the coil when said current is greater than the setpoint value during the holding phase, and means for commanding switching to inrush phase when an unscheduled movement is detected.

2. The device according to claim 1, wherein the detection means comprise means for detecting the direction of variation of the current flowing in the coil, an unscheduled movement being considered as being detected when, during the holding phase, the current is greater than the setpoint value and is at the same time increasing.

3. The device according to claim 2, wherein the means for detecting the direction of variation of the current comprise means for determining a quantity representative of the differential of the current with respect to time, an unscheduled movement being considered as being detected when, during the holding phase, the current is greater than the setpoint value and said quantity is positive.

4. The device according to claim 1, wherein an unscheduled movement is detected by the detection means when, during the holding phase, the current is greater than the setpoint value during a preset time.

5. The device according to claim 4, wherein the means for measuring the current comprise means for sampling the current, with a preset sampling period, and an unscheduled movement is detected if more than two successive samples of the current are greater than the setpoint value during the holding phase.

6. The device according to claim 5, wherein an unscheduled movement is detected when more than four successive samples of the current are greater than the setpoint value during the holding phase.

7. The device according to claim 5, wherein the sampling period is about a few hundred microseconds.

8. The device according to claim 1, wherein, the regulating means controlling turn-on of the electronic switch with a fixed chopping period and a variable duty cycle factor according to the difference between the value of the current flowing in the coil and the setpoint value, the detection means compare the duty cycle factor with a setpoint duty cycle factor at each chopping period.

9. The device according to claim 8, wherein an unscheduled movement is considered as being detected when, during a holding phase, the duty cycle factor is lower than the setpoint duty cycle factor during at least two successive chopping periods.

10. The device according to claim 8, wherein an unscheduled movement is considered as being detected when, during the holding phase, the duty cycle factor is at the same time decreasing and lower than the setpoint duty cycle factor during at least two successive chopping periods.

* * * * *